US006183293B1

(12) United States Patent
Kieninger

(10) Patent No.: US 6,183,293 B1
(45) Date of Patent: Feb. 6, 2001

(54) ELECTRICAL CONNECTOR LATCHING MECHANISM

(75) Inventor: Hans Kieninger, Stuttgart (DE)

(73) Assignee: ITT Manufacturing Enterprises, Inc., Wilmington, DE (US)

( * ) Notice: Under 35 U.S.C. 154(b), the term of this patent shall be extended for 0 days.

(21) Appl. No.: 09/376,653

(22) Filed: Aug. 18, 1999

(30) Foreign Application Priority Data

Aug. 28, 1998 (DE) ..... 198 39 342

(51) Int. Cl.[7] ..... H01R 13/73
(52) U.S. Cl. ..... 439/551; 439/312; 439/321
(58) Field of Search ..... 439/550, 551, 439/565, 321, 546, 320, 312, 318

(56) References Cited

U.S. PATENT DOCUMENTS

| | | | | |
|---|---|---|---|---|
| 4,472,013 | * | 9/1984 | Frear | 439/312 |
| 4,478,473 | * | 10/1984 | Frear | 439/312 |
| 4,478,474 | * | 10/1984 | Gallusser et al. | 439/312 |
| 4,484,790 | * | 11/1984 | Schildkraut et al. | 439/312 |
| 4,487,470 | * | 12/1984 | Knapp et al. | 439/312 |
| 4,508,407 | * | 4/1985 | Ball | 439/312 |
| 4,519,661 | * | 5/1985 | Brush, Sr. et al. | 439/312 |
| 4,536,048 | * | 8/1985 | Schildkraut et al. | 439/312 |
| 4,588,245 | * | 5/1986 | Schwartz et al. | 439/312 |
| 4,793,821 | | 12/1988 | Fowler, et al. | 439/321 |
| 4,820,184 | * | 4/1989 | Brandes | 439/312 |
| 5,399,096 | * | 3/1995 | Quillet et al. | 439/312 |
| 5,605,475 | * | 2/1997 | Ogawa | 439/321 |
| 5,618,204 | * | 4/1997 | Nix et al. | 439/551 |
| 5,653,605 | * | 8/1997 | Woehl et al. | 439/321 |
| 5,931,695 | * | 8/1999 | Scully et al. | 439/550 |

FOREIGN PATENT DOCUMENTS

| | | |
|---|---|---|
| 3507525 C1 | 3/1985 | (DE) . |
| 9003016 U | 7/1991 | (DE) . |
| 2 294 816 | 11/1994 | (GB) . |

* cited by examiner

*Primary Examiner*—Paula Bradley
*Assistant Examiner*—Katrina Davis
(74) *Attorney, Agent, or Firm*—Thomas L. Peterson

(57) ABSTRACT

An electrical connector for mounting in an opening (2) of a wall (3), includes a connector element (4) having a bayonet threaded shaft (7) that projects into the opening and a clamp element (5) with a nut part that can be threaded onto the threaded shaft until shoulders on the two elements abut the wall, where the connector includes a latching mechanism (40) that prevents loosening of the clamp member. The latching mechanism includes a holder ring (54) on the connector element, that lies within a latch ring (50) on the clamp element. The latch ring has inwardly-extending projections (42, 44), while the holder ring carries at least one latch member (14). When the clamping member is tightened on the connector element, the distal end **(15*a*)** of the latch member readily rides over the projections. However, when the clamping member begins to loosen, the distal end resists such loosening.

4 Claims, 3 Drawing Sheets

ELECTRICAL CONNECTOR LATCHING MECHANISM

BACKGROUND OF THE INVENTION

It is common to provide an electrical connector that mounts in an opening of a wall which may be in an appliance. The connector has a connector element with a threaded shaft that is projected through the opening in the wall, and a clamping member that is threaded onto the shaft. If threads with a small helical angle are used, then friction between the tightened threaded parts resists unscrewing. Locking washers are sometimes used, which add friction when the threaded elements are tightened.

In many applications, it is desirable to use bayonet threads, which are threads having a large helical angle, to permit rapid attachment. Most bayonet threads extend by less than a complete turn around the axis. Bayonet threads have the advantage that they allow elements to be rapidly fastened by turning one element by less than a complete turn, or only slightly greater than a complete turn, until the threads are completely tightened. However, with the large helical angle of a bayonet thread, they are subject to rapid loosening, especially if subjected to vibrations. Ordinary lock washers are generally not sufficient to prevent loosening. An electrical connector with parts that could be threadably connected using a large helical angle thread such as a bayonet thread, and which resisted accidental loosening, would be of value.

SUMMARY OF THE INVENTION

In accordance with one embodiment of the present invention, an electrical connector for mounting in an opening in a wall is provided, where the connector includes connector and clamp elements that can be threaded together with a large helical angle thread such as a bayonet thread, for resisting loosening. The connector element has a holder ring and at least one latch member mounted on the holder ring. The clamp element has a latch ring which surrounds the holder ring and that has a plurality of radial projections. The latch member has a fixed proximal end, and has a distal end biased to a position in the path of the projections as an element turns. The latch member can be a resilient beam whose distal end has a radially outer surface that is easily deflected inwardly during turning in a direction to tighten the threads. However, the distal end has a tip with a surface that greatly resists turning of the elements in a direction to loosen the threaded connection. The latch member is preferably an elastomerically deflectable beam.

The novel features of the invention are set forth with particularity in the appended claims. The invention will be best understood from the following description when read in conjunction with the accompanying claims.

DESCRIPTION OF THE PREFERRED EMBODIMENTS

Figure 4:
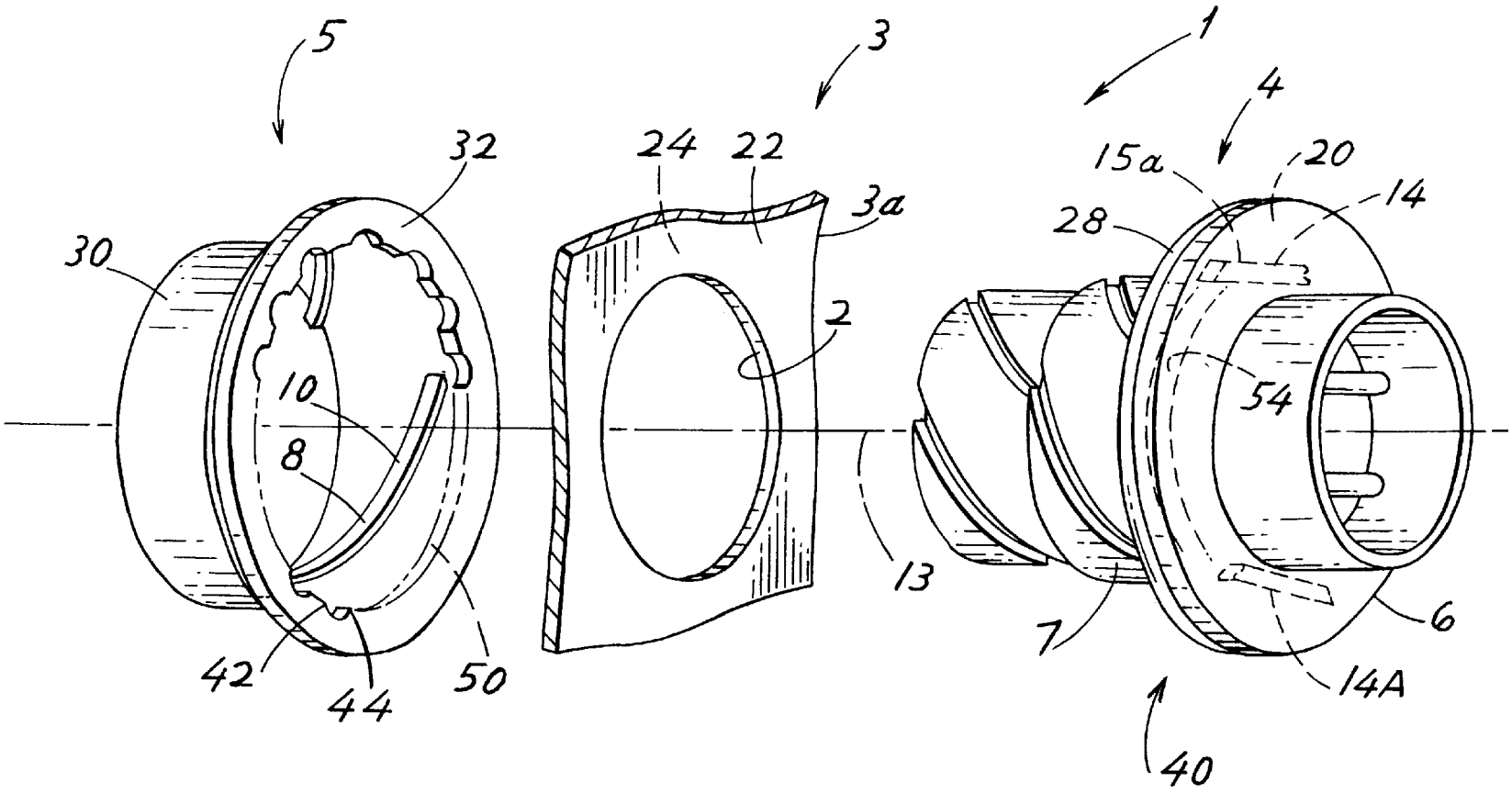
FIG. 4 is an exploded isometric view of the connector and wall of FIG. 1.

FIG. 4 illustrates an electrical connector 1 of the present invention, that includes a connector element 4 and a clamp element 5 that can be joined together to mount the electrical connector on a wall 3. The particular wall is a thin wall 3*a* with an opening 2. The connector element has a threaded shaft 7 that extends along an axis 13 and that can be inserted through the wall opening 2 until a first shoulder 20 on a flange 6 substantially abuts a first side 22 of the wall, which lies opposite a second side 24. Actually, the connector element includes an O-ring 28 that lies between the wall and first shoulder 20 and that is compressed between them. A clamp element 5 has an internally threaded nut part 30 with a thread 8 formed by an inwardly-protruding bayonet element 10. The nut part 30 can be screwed onto the threaded shaft 7 until a second shoulder 32 on the clamp element abuts the second side 24 of the wall.

The elements have three bayonet threads that each extends by about a half turn about the axis 13, so the clamp element can be installed by turning it about 180°. Any slight loosening by vibration, moves the clamp element 5 considerably away from the wall's second side 24, enabling further loosening. To prevent such loosening, applicant provides a latch mechanism 40 that includes latch members 14, 14A on a holder ring 54 (which is not necessarily primarily circular) of the connector element 4, that engage projections 42, 44 on the clamp element 5. The clamp element 5 has a latch ring 50 with numerous teeth having opposite sides forming inwardly-extending (relative to axis 13) projection sides or projections 42, 44. It can be seen from the figures such as FIG. 3, that the space between each pair of adjacent teeth is a half circle. When the elements 4, 5 are fully threaded together, the latch ring 50 lies around the holder ring 54 on the connector element. The latch members 14, 14A are mounted on the holder ring and can engage the projections 42, 44 on the latch ring to resist unscrewing of the elements from each other.

Figure 2:
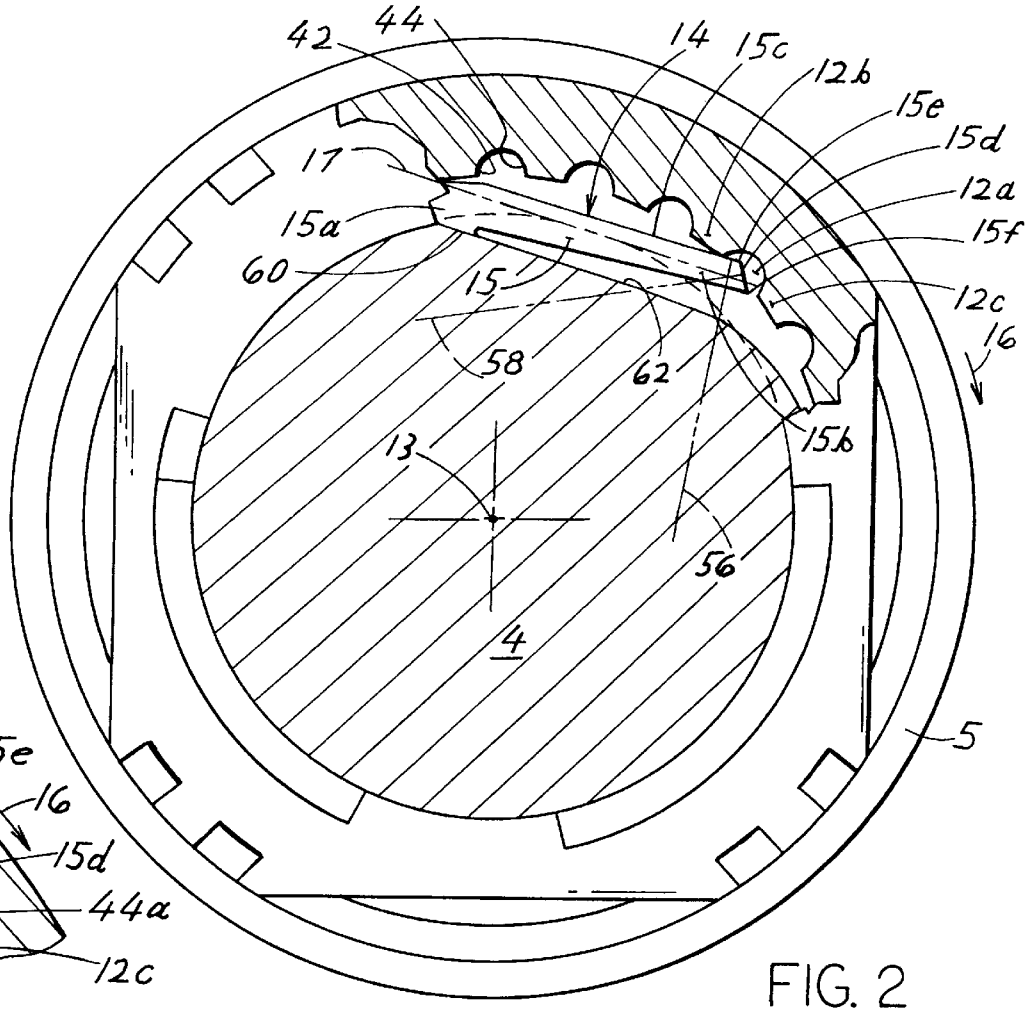
FIG. 2 is a view taken on line 2—2 of FIG. 1.
Figure 3:
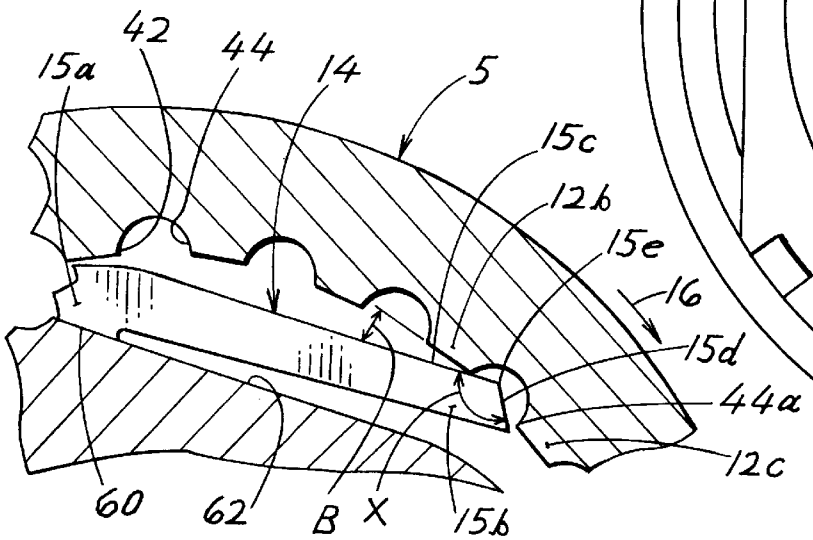
FIG. 3 is an enlarged view of a portion of FIG. 2.

FIGS. 2 and 3 show a latch member 14 mounted on the holder ring. The latch member extends parallel to an imaginary line 17 that is tangential to the holder ring and its axis 13. The latch member has a proximal end 15*a* that is fixed against shifting, to a location 60 on the holder ring, and has a distal end 15*b* that is free to move radially outward and inward (primarily toward and away from axis 13), and which is biased towards the position shown in FIGS. 2 and 3. The holder ring has a groove or recess 62 that permits radially inward movement of the distal end 15*b* of the latching member.

The clamping element 5 is turned in the direction of arrow 16 to tighten it on the threaded shaft of the connector element. During such rotation of the clamping element, teeth 12*b*, 12*c* of the clamp element, that form the projection sides 42, 44, move across an outer edge 15*e* of the latching member distal end. The outer surface 15*c* of the latch member extends at an angle B of only about 20° to the direction of movement of the teeth such as 12*b*, so there is little resistance to rotation of the clamp element 5 in the tightening direction of arrow 16. However, if the clamp element 5 begins to loosen by turning in a direction opposite to arrow 16, then a projection side 44 will engage a face 15*d* at the distal tip of the latching member. The face 15*d* faces in a direction primarily away from the proximal end 15*a*. As a result, it requires a large force of the projection at 44*a* against the face 15*d* to move the distal end 15*b* radially inward.

An imaginary line 56 that is normal to the latch member surface 15*c* is spaced from the proximal end 15*a* by about the length of the latch member. An imaginary line 58 that is normal to the tip face 15*d* is much closer to the proximal end 15*a*. There is an obtuse angle x between the surfaces 15*c* and

15*d*. Friction of a projection 44 against the tip face 15*d* tends to move the latch member distal end radially outward to jam it against the projection 44. If the coefficient of friction is high, then the clamp element cannot be turned in a reverse direction, unless a tool is installed to deflect the distal end 15*b* radially inward prior to unscrewing the clamp element. The latch member can be provided with a low friction cap to form its distal end. The latch member 14 is in the form of a beam that is resiliently bendable, preferably by forming the latching member of an elastomeric material (e.g. rubber). The latch member 14 is thick enough in a direction perpendicular to its length and in a direction radial to the axis 13, to resist column collapse when a tooth pushes against the distal end 15*d* of the latch member.

Figure 1:
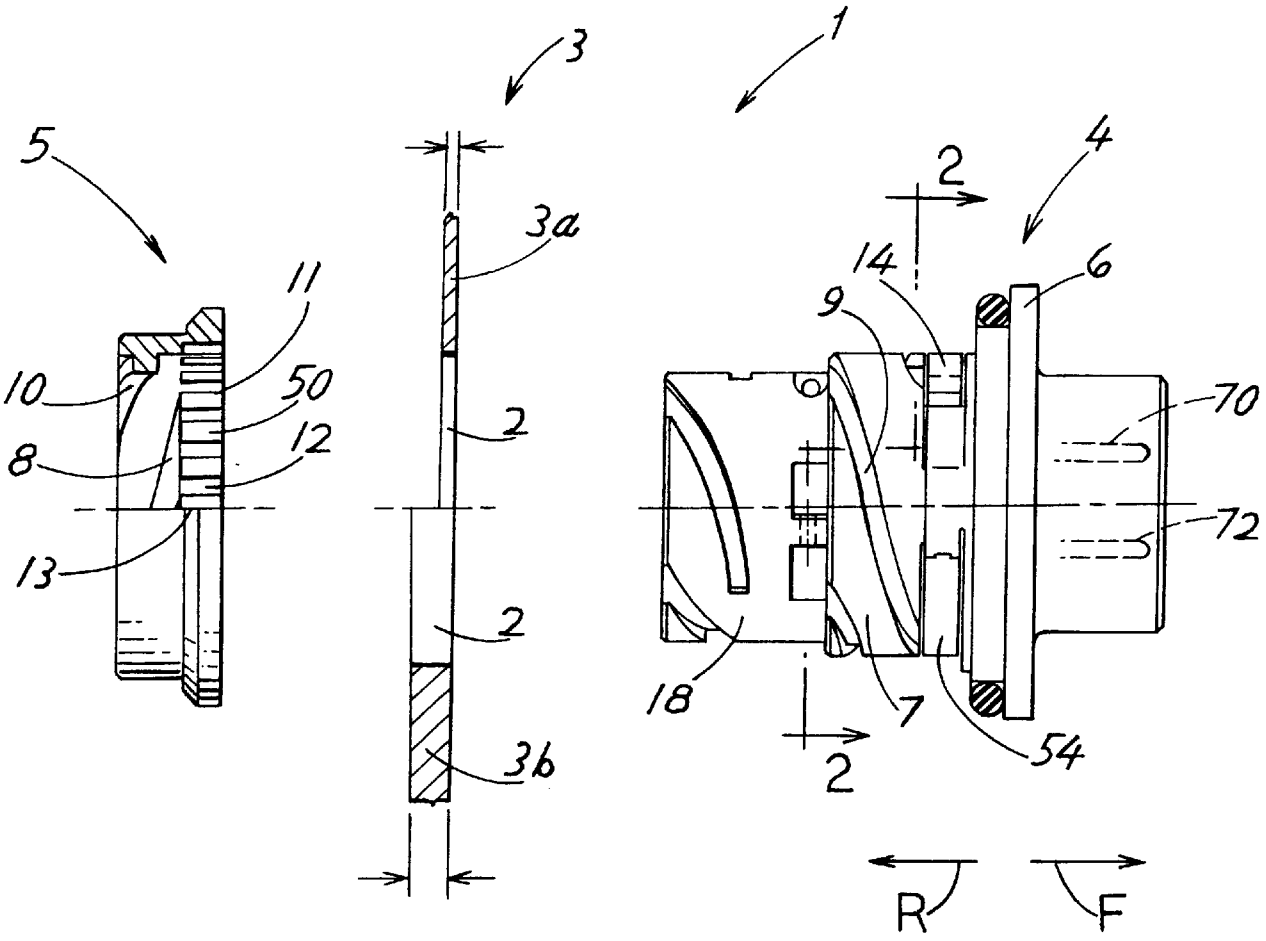
FIG. 1 is an exploded side elevation view of an electrical connector and wall constructed in accordance with the present invention, with a thin wall shown above the axis and a thicker wall shown below the axis, and with the clamp element shown in a sectional view above the axis and in an elevation view below the axis.

Although a single latching member 14 can be used, Applicant prefers to provide two latching members on diametrically opposite sides of the connector element. As shown in FIG. 1, the width of the latching member 14 and of the projections or latching teeth 12 that form the projections, is sufficient that they will engage each other for a variety of thicknesses of the wall 3, between the small thickness 3*a* and the large thickness 3*b*. A particular connector element 4 is shown as having a pair of pin contacts 70, 72, although it can have socket contacts. The rear end of the connector element forms a threaded part 18 that can receive an end cap.

Thus, the invention provides an electrical connector with connector and clamp elements that can be screwed together to mount them at an opening in a wall, which includes a latching mechanism that greatly resists loosening of the threaded connection when the elements have been fully threaded together. The latching mechanism includes a latch ring on one of the elements and a holder ring with at least one latch member on the other element. The latch member has a proximal end fixed to the holder ring and has a distal end that projects into the path of projections on the latch ring when the latch ring turns. The distal end of the latch member is oriented so unscrewing of the elements results in pushing the distal end of the latch member primarily towards the pioximal end, so the elements cannot be unscrewed by a low or moderate torque. The holder ring is shown lying radially within the latch ring, but can lie radially outside it, or axially beside it.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector which includes a connector element that has a threaded shaft that lies on an axis, and a clamp element that has an internally threaded nut part that lies on said axis and that can threadably fit on said threaded shaft, wherein:

said clamp element has a latch ring forming a ring of projections;

said connector element has a holder ring and at least one elongated latch member having a proximal end mounted on said holder ring and a distal end that projects to a position radially outward of said proximal end and that engages said projections, with said distal end resisting turning of said clamp element to unscrew said clamp element from said shaft, but with said distal end being deflectable to allow said ring of projections on said clamp element to be turned in at least a direction to screw said clamp element tightly onto said threaded shaft;

said latch member is formed of elastomeric material and is thick enough in a direction perpendicular to its length and largely radial to said axis to resist column collapse by one of said projections pushing against said distal end of said latch member.

2. An electrical connector which includes a connector element that has a threaded shaft that lies on an axis, and a clamp element that has an internally threaded nut part that lies on said axis and that can threadably fit on said threaded shaft, wherein:

said clamp element has a latch ring forming a ring of projections and with each projection having a radially inner end;

said connector element has a holder ring and at least one latch member having a proximal end mounted on said holder ring and a distal end that projects to a position radially outward of said proximal end and that engages said projections with said latch being deflectable to allow said ring of projections on said clamp element to be turned in at least a first direction to screw said clamp element tightly onto said threaded shaft;

said distal end of said latch member has a tip forming a surface (15*d*) that engages one of said projections during an attempted rotation of said clamp element in a second direction, with one portion of said tip lying radially outward of the projection inner end and another portion of said tip lying radially inward of the projection inner end.

3. The electrical connector described in claim 2 wherein:

said latch member has a radially outer surface (15*c*) that engages said projections during rotation of said clamp element in said first direction;

said tip of said latch member forms an angle (X) between said first surface and said surface of said tip, with said angle being an obtuse angle.

4. An electrical connector which includes a connector element that has a threaded shaft that lies on an axis, and a clamp element which has an internally threaded nut part that lies on said axis and that can threadably fit on said threaded shaft, wherein:

said clamp element has a latch ring forming a ring of projections, with a space between each pair of adjacent projections;

said connector element has a holder ring and at least one latch member having a proximal end mounted on said holder ring and a distal end that projects to a position radially outward of said proximal end and that engages said projections with said distal end being deflectable to allow said ring of projections on said clamp element to be turned in at least a direction to screw said clamp element tightly onto said threaded shaft;

each of said spaces between a pair of adjacent ones of said projections is in the form of a half circle.

* * * * *